United States Patent [19]

Asami et al.

[11] Patent Number: 4,834,134

[45] Date of Patent: May 30, 1989

[54] TWO-WAY DELIVERY VALVE STRUCTURE OF A FUEL DISCHARGE VALVE IN A FUEL INJECTION PUMP

[75] Inventors: Toshiaki Asami; Takayuki Ikeda; Toru Mogi; Tomie Kobayashi, all of Higashi-Matsuyama, Japan

[73] Assignee: Diesel Kiki Co., Ltd., Tokyo, Japan

[21] Appl. No.: 158,238

[22] Filed: Feb. 19, 1988

[30] Foreign Application Priority Data

Mar. 27, 1987 [JP] Japan ..... 62-44268

[51] Int. Cl.[4] ..... F02M 59/46

[52] U.S. Cl. ..... 137/493.3; 417/296

[58] Field of Search ..... 137/493.1, 493.2, 493.3, 137/493.4, 493.5, 493.6; 417/296

[56] References Cited

U.S. PATENT DOCUMENTS

| | | | |
|---|---|---|---|
| 2,006,141 | 6/1935 | Hussey | 137/493.4 X |
| 4,459,086 | 7/1984 | Hafele | 137/493.5 X |
| 4,467,767 | 8/1984 | Kampichler | 417/296 X |
| 4,648,369 | 3/1987 | Wannewetsch | 137/493.3 X |

FOREIGN PATENT DOCUMENTS 60-119366 6/1985 Japan .

*Primary Examiner*—Robert G. Nilson

*Attorney, Agent, or Firm*—Wenderoth, Lind & Ponack

[57] ABSTRACT

A two-way delivery valve structure of a fuel discharge valve in a fuel injection pump has a valve holder formed in an interior part thereof with an oil chamber communicating with a fuel injection pipe, a valve seat secured in the holder and formed in an interior part thereof with a fuel outlet conduit communicating with a pressure chamber, an discharge valve communicating with the pressure chamber and for engaging with and disengaging from an opening of the fuel outlet conduit so as to open and close the conduit, and a two-way delivery valve mounted to the fuel discharge valve and provided in an interior part thereof with a valve chest communicating with the fuel discharge valve, the two-way delivery valve being provided in the valve chest with a movable valve comprising a check valve for opening and closing a communicating portion communicating with the oil chamber, a valve casing constituting the two-way delivery valve being provided separately from the fuel discharge valve, the valve casing and fuel discharge valve being integrally assembled through engaging reference surfaces thereof.

4 Claims, 2 Drawing Sheets

TWO-WAY DELIVERY VALVE STRUCTURE OF A FUEL DISCHARGE VALVE IN A FUEL INJECTION PUMP

BACKGROUND OF THE INVENTION

1. Field of the Invention

This invention relates to an improvement of a two-way delivery valve structure of a fuel discharge valve in a fuel injection pump.

2. Description of the Prior Art

A conventional fuel discharge valve of a fuel injection pump installed in a diesel engine is, in general, closed in order to block one end of a fuel injection pipe after fuel is discharged. Therefore, the remaining pressure sealed in the injection pipe becomes a pressure wave and moves to and fro within the pipe. This remaining pressure is often amplified to open the fuel discharge valve to inject fuel again.

Therefore, in order to prevent such an undesirable occurrence as mentioned, the remaining pressure within the injection pipe must be lowered as soon as the fuel is injected. However, if the pressure within the injection pipe is lowered to a predetermined value or less, the next injection of fuel is not smoothly performed. Therefore, it is necessary that the remaining pressure within the injection pipe is regulated to be in a predetermined range. In recent time, an equal pressure valve or two-way delivery valve comprising a check valve is integrally provided to a fuel discharge valve so as to establishing the pressure within the injection pipe generally equal to that of a pressure chamber by releasing the remaining pressure within the injection pipe after the fuel is injected, into the pressure chamber in which the internal pressure is lowered.

For example, Japanese Patent Application Early Laid-open Publication No. Sho 60-119366 discloses an equal pressure valve, in which a plug member with a through-hole formed therein is press fitted to or caulked to an upper end of a tubular guide pin which is integral with a valve closing member as a fuel discharge valve, thereby to establish a preload to a return spring for energizing the closing member toward a valve seat of the plug member.

However, in the conventional equal pressure valve, the plug member is secured to the upper end of the guide pin by pressure fit for caulking as mentioned. Therefore, although it has the advantage in that the preload can be uniformly established, it is difficult to maintain a uniform fitting of the plug member. For example, the fitting position of the plug member is not constant or the plug member is apt to fall. As a result, the preload becomes inconstant and the sitting posture of the closing member becomes unstable. Moreover, since the fuel discharge valve is integral with the guide pin, much difficulty is encountered when the discharge valve is manufactured. The present invention is accomplished in order to overcome the above-mentioned problems inherent in the prior art.

SUMMARY OF THE INVENTION

It is therefore an object of the present invention to provide an equal pressure valve or a two-way delivery valve structure of a fuel discharge valve in a fuel injection pump, in which a valve casing and a fuel discharge valve constituting an equal valve are separately formed and then are integrally assembled or fitted in order to fascilitate an easy manufacture.

Another object of the present invention is to provide a two-way delivery valve structure of a fuel discharge valve in a fuel injection pump, in which the seat property of the equal two-way delivery valve is improved.

A further object of the present invention is to provide a two-way delivery valve structure of a fuel discharge valve in a fuel injection pump, in which the horizontal degree as well as the vertical degree of engaging surfaces of the valve casing and fuel discharge valve are finalized precisely and both the valve casing and fuel discharge valve are integrally fitted or assembled with reference to the engaging surfaces so that they can be precisely and uniformly fitted or assembled by effectively preventing the falling of the valve casing with respect to the fuel discharge valve.

In order to achieve the above-mentioned objects, there is essentially provided a two-way delivery valve structure of a fuel discharge valve in a fuel injection pump comprising a valve holder formed in an interior part thereof with an oil chamber communicating with a fuel injection pipe, a valve seat secured in the holder and formed in an interior part thereof with a fuel outlet conduit communicating with a pressure chamber, a fuel discharge valve communicating with the pressure chamber and for engaging with and disengaging from an opening of the fuel outlet conduit so as to open and close the conduit, and a two-way delivery valve mounted to the fuel discharge valve and provided in an interior part thereof with a valve chest communicating with the fuel discharge valve, said equal pressure valve being provided in the valve chest with a movable valve comprising a check valve for opening and closing a communicating portion communicating with the oil chamber, a valve casing constituting the equal pressure valve being provided separately from the fuel discharge valve, the valve casing and fuel discharge valve being integrally assembled through engaging reference surfaces thereof.

The above-mentioned objects and further features and advantages of the present invention will become more apparent from the following detailed description with reference to the accompanying drawings.

DETAILED DESCRIPTION OF THE PREFERRED EMBODIMENT

Figure 1:
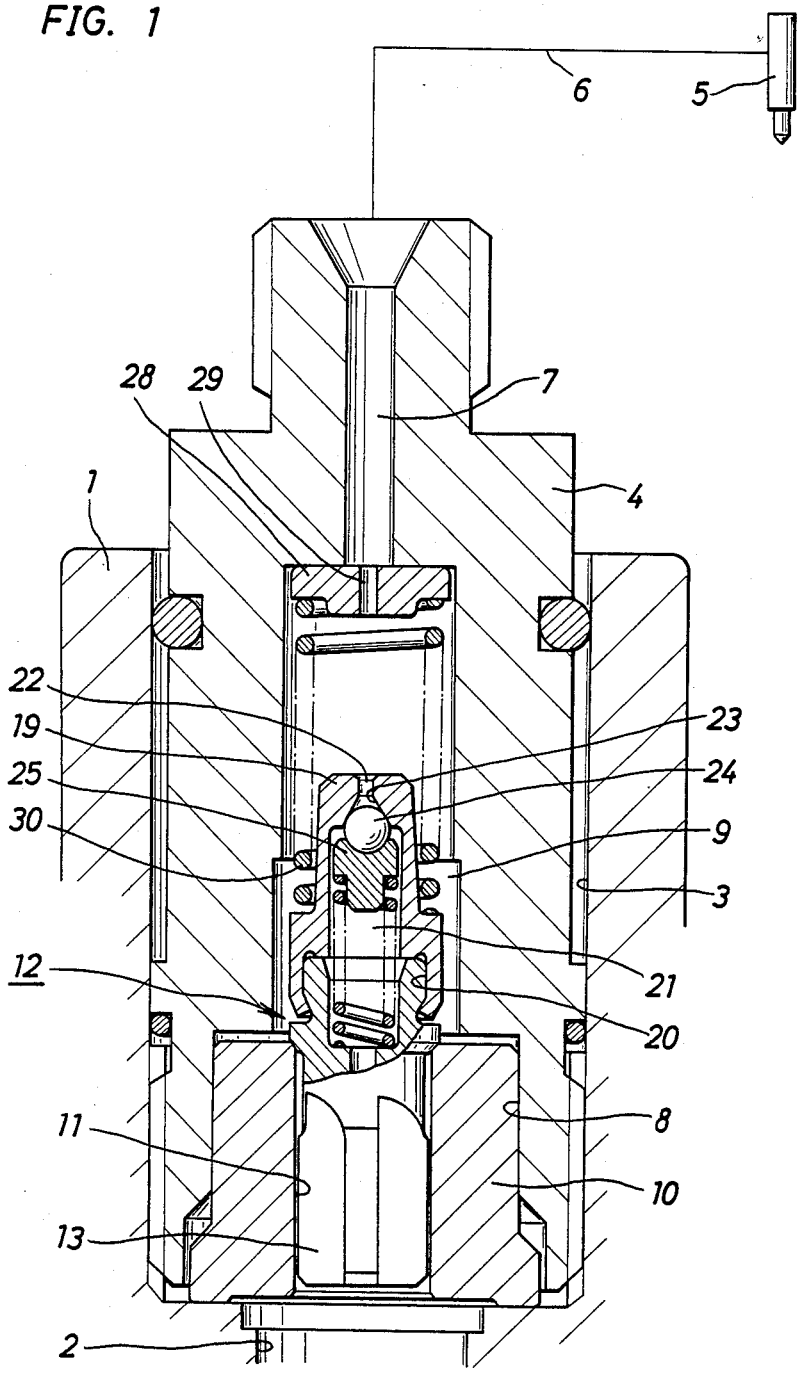
FIG. 1 is a sectional view showing one embodiment of the present invention.
Figure 2:
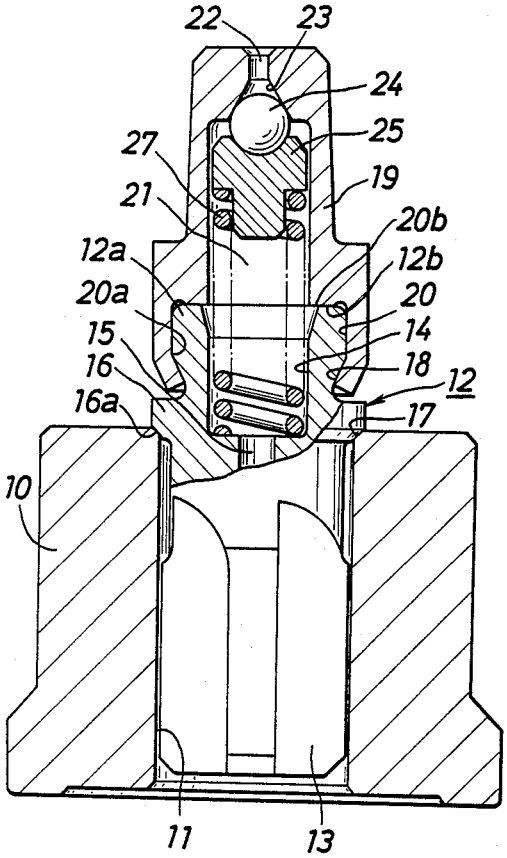
FIG. 2 is a sectional view showing an important portion of the present invention in enlarged scale.
Figure 3:
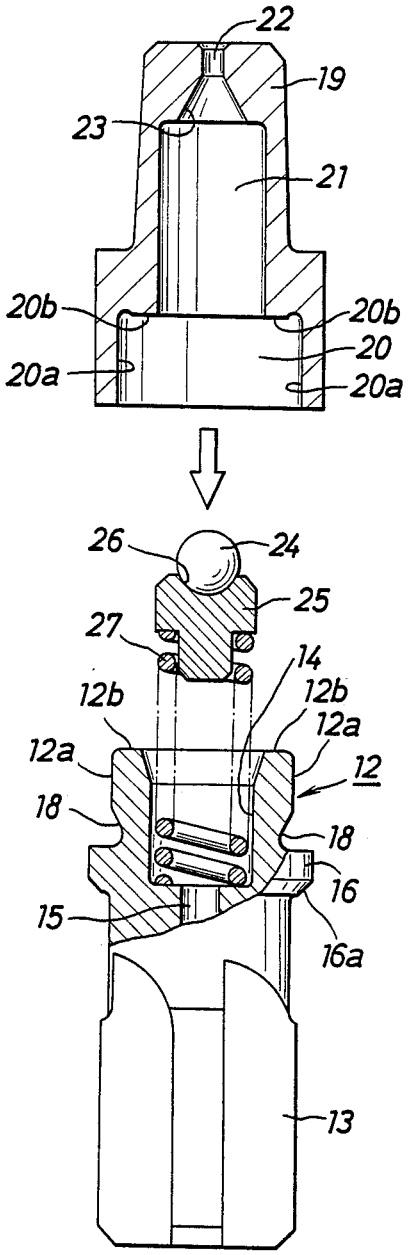
FIG. 3 is a sectional view showing one example of a manufacturing process of two-way delivery valve according to the present invention.

The present invention will be described hereunder with reference to the illustrated embodiment in which the present invention is applied to an in-line pump. In FIGS. 1 through 3, 1 denotes a cylindrical valve housing secured to each end face of corresponding number of openings (not shown) corresponding to the number of cylinders of an engine formed in a pump housing (not shown). The valve housing 1 is provided in an interior part thereof with a hollow chamber 3 communicating with a pressure chamber 2. A valve holder 4 is screwed into the chamber 3 and secured therein. The valve holder 4 is provided with first a fuel passageway 7 opened up at an end face thereof and communicating with a fuel injection pipe 6 connected to a fuel discharge valve 5. The valve holder 4 is provided in an interior part thereof with a holder chamber 8 and an oil chamber 9 having different bore diameters and communicating with the first fuel passageway 7. Of these, the holder chamber 8 contains therein a valve seat 10 placed on a bottom portion of the hollow chamber 3. The seat 10 is formed therein with a fuel outlet conduit 11. The fuel outlet conduit 11 vertically movably contains therein a feed oil guide portion 13 of a fuel discharge valve 12.

The fuel discharge valve 12 is provided with a first hollow 14 opened up in the upper end face thereof. The first hollow 14 is provided with an oil guide conduit 15 opened up at the bottom portion thereof and communicating with the pressure chamber 2. The fuel discharge valve 12 is provided at a raised intermediate portion thereof with a flange-shaped engaging piece 16. A lower peripheral surface of the engaging piece 16 is formed with a seat portion **16*a* engagable with a seal surface formed at the edge of an outlet port of the fuel outlet conduit 11. The peripheral surface of a base portion immediately above the engaging piece 16 is provided with a neck portion 18 comprising a reduced diameter portion having an upwardly tapered surface. The neck portion 18 is connected with a lower end portion of a valve casing 19** by caulking or sealing means.

The valve casing 19 comprises a cylindrical body with a step portion. The valve casing 19 is provided with a second hollow 20 opened up at a lower end face at the large diameter side thereof and engagable with an upper end portion of the fuel discharge valve 12, i.e., an axial end portion upper than the neck portion 18 of the valve 12. An axial peripheral surface **12*a* and an axial end face 12*b*, as reference engaging surfaces, constituting the axial end portion of the fuel discharge valve 12, as well as a peripheral surface 20*a* of the second hollow 20 and a bottom surface 20*b* thereof, as reference engaging surfaces, engagable with them are precisely machined the horizontal degree or vertical degree thereof into smooth surfaces, so that the valve casing 19 is prevented from falling with respect to the fuel discharge valve 12** due to the afore-mentioned connection.

The valve casing 19 is provided at an internal part thereof with a valve chest 21 communicating with the second hollow 20. The valve casing 19 is also provided at an upper end face thereof with a conduit or second fuel passageway 22 opened up at an upper end face thereof and communicating with the valve chest 21. The conduit 22 is formed with a tapered seat surface 23 at an inner peripheral portion near the opening portion thereof so that a movable valve 24 such as a ball valve can be well sat. The movable valve 24 is contained in a valve seat 26 having a concave surface formed at an upper end face of a spring bearing 25. A spring 27 is interposed between the lower surface of the spring bearing 25 and the bottom portion of the hollow 14 to energize the spring bearing 25 upward so as to push the movable valve 24 against the seat surface 23 to close the valve 24.

In the figures, reference numeral 28 denotes a spring bearing having a through-hole at the center thereof and contained in the oil chamber 9. A spring 30 is interposed between the under-surface of the spring bearing 28 and a shoulder portion of the valve casing 19 to push the spring bearing 28 against the upper end face of the oil chamber 9 and also to energize the fuel discharge valve 12 integral with the valve casing 19 downward to push the seat portion **16*a* against the seal surface 17 so as to close the discharge valve 12**.

With the above-mentioned construction of the two-way delivery valve structure, since the fuel discharge valve 12 and valve casing 19 are separate bodies, the discharge valve 12 can be manufactured easily compared with the prior art in which these component parts are integrally formed.

Next, in order to fit or assemble a valve casing to the discharge valve 12, as shown in FIG. 3 for example, the spring 27 is disposed within the first hollow 14 of the fuel discharge valve 12, then the spring bearing 25 with the movable valve 24 contained therein is put on the upper end of the spring 27, and then the valve casing 19 is held with the first hollow 20 facing toward the movable valve 24 while maintaining the foregoing state. Then, the casing 19 is moved in the direction as shown by an arrow in FIG. 3 and the movable valve 24, spring bearing 25 and spring 27 are accommodated within the valve chamber 21, and at the same time, the hollow 20 is fitted to the axial end portion of the fuel discharge valve 12.

In this way, when the bottom surface **20*b* within the second hollow 20 is abutted against the axial end face 12*b*, the fitting operation of the valve casing 19 is stopped and the lower end portion of the valve casing 19 is caulked or sealed by suitable means while maintaining the foregoing state. And, the lower edge bent inwardly is fitted to the neck portion 18 for connection. In the present application, the margin of the opening portion of the hollow 20 is bent inwardly to effectively seal the valve casing 19. This aims at preventing the valve casing 19 from coming off. The valve casing 19 and the fuel discharge valve 12 are connected with each other by means of intimate fitting (press-fit) between the hollow 20 and the axial end portion of the discharging valve 12**;

Since the peripheral surface **20*a* of the hollow as an engaging reference surface is engaged with the axial peripheral surface 12*a* and since the bottom surface 20*b* within the hollow is engaged with the axial end face 12*b*, the valve casing 19 connected to the axial end portion of the fuel discharge valve 12 is aligned with the fuel discharge valve 12, thereby to more effectively prevent the falling of the valve casing 19. Therefore, since the seat surface 23 is situated on the extension of the axis of the fuel discharge valve 12 and since the displacement is effectively prevented, the energizing direction of the movable valve 24 and the sitting direction of the valve 24 is conformed with each other. As a result, the sitting posture is stabilized. Further, since the pushing force toward the seat surface 23 is intensified, the sealing property of the movable valve 24** is improved.

Moreover, since the bottom surface **20*b* of the valve casing 19 is engaged with the axial end face 12*b* to regulate the connecting position thereof with respect to the fuel discharge valve 12, i.e., the height of the seat surface 24 to a predetermined position, the preload of the spring 2 for energizing the movable valve 24** can be uniformly established. Thus, the irregularity of the preload can be prevented.

In this way, when the integrally assembled two-way delivery valve assembly, as shown in FIG. 1, is placed within the valve holder 4 and the valve seat 10, the seat portion **16*a* of the fuel discharge valve 12 is normally pushed against the seal surface 17 of the fuel outlet conduit 11 t close the fuel discharge valve 12. Within the valve casing 19, the movable valve 24 is pushed against the seat surface 23 by the spring 27 to maintain a closing posture of the movable valve 24**.

Under the above-mentioned situation, the fuel injection pump is driven, and a plunger (not shown) is lifted upward to pressurize the fuel contained in the pressure chamber 2. When the pressure within the pressure chamber 2 exceeds the combined force or resultant force of a set force of the spring 30 and the internal pressure of the injection pipe 6, the fuel discharge valve 12 is pushed up integrally together with the valve casing 19 against it. As a result, the seat portion 16*a* is separated from the seat surface 17 to open the valve. As a result, the high pressure fuel is pushed into the oil chamber 9 out of the pressure chamber 2 via the fuel outlet conduit 11, then discharged into the fuel injection pipe 6 from the fuel passageway 7 and then discharged into the fuel injection valve 5 under pressure.

When the plunger is further lifted upward and when a cutoff hole (not shown) is communicated with the pressure chamber 2 to lower the pressure within the chamber 2, the fuel discharge valve 12 is pushed back by the spring 30 and the pressure within the injection pipe 6. As a result, the seat portion 16*a* is pushed against the seal surface 17 thereby to stop the discharge of fuel. As a result, the fuel injection of the fuel injection valve 5 is also finished.

Given that the fuel discharge valve 12 is closed when the injection of fuel is finished, one end of the fuel injection pipe 6 is blocked. The other end thereof is also blocked since the injection valve 5 is closed. As a result, the pressure wave of the high pressure fuel sealed therebetween moves to and fro within the fuel injection pipe 6. The pressure wave is gradually amplified as it repeats a propagation and reflection. The pressure is acted on the fuel injection valve 5 on one hand and is acted on the movable valve 24 within the valve holder 4 on the other hand.

More specifically, the pressure wave is entered into the oil chamber 9 from the fuel injection pipe 6 via the first fuel passageway 7 to act on the second passageway 22 communicating with the chamber 9 to try to push down the movable valve 24. When the pressure exceeds the set force of the spring 27 for regulating the opening degree of the movable valve 24, the movable valve 24 is pushed down against the force of the spring 27 and opened.

As a result, the pressure wave is entered into the valve chamber 21, then guided out of the chamber 21 by the oil guide conduit 15 and absorbed within the pressure chamber 2 under a normal pressure. Therefore, the pressure within the fuel injection pipe 6 is restricted to lower than the opening pressure of the fuel injection valve 5, and the fuel injection valve 5 is not injected again by the pressure remained within the injection pipe 6.

In this way, when the pressure within the fuel injection pipe 6 is gradually brought to the level of the pressure of the pressure chamber 2, the movable valve 24 is pushed up by the spring 27 against the internal pressure of the pipe 6 and pushed against the seat surface 23 to close the valve. Since the preload of the spring 27 is uniformly established during a sequence of opening and closing operation of the movable valve 24 as mentioned, the irregularity of the opening and closing operation, i.e, awkward opening and closing operation of the valve can be prevented, and the internal pressure of the pipe can be uniformly lowered.

Although the present invention has been described in connection with a preferred embodiment thereof, it will be appreciated that man modifications and variations will readily occur to those skilled in the art without departing from the spirit and scope of the present invention.

What is claimed is:

1. A two-way delivery valve structure of a fuel discharge valve for a fuel injection pump, said two-way delivery valve structure comprising:

a valve holder having a holder chamber for receiving a valve seat therein, an oil chamber for holding fuel and for receiving an upper neck portion of a fuel discharge valve and a valve casing therein, and a first fuel passageway for fluidly communicating said oil and a fuel injection pipe;

a valve seat received in said holder chamber, a fuel outlet conduit in said valve seat for receiving a slidable feed oil guide portion therein and for fluidly communicating said oil chamber and a pressure chamber of a fuel injection pump;

a slidable feed oil guide portion in said fuel outlet conduit of said valve seat;

a fuel discharge valve having an integral upper neck portion, an integral middle engaging piece engaging said valve seat, and an integral lower fuel outlet conduit portion, said integral lower fuel outlet conduit portion being received in said slidable feed oil guide portion in said fuel outlet conduit of said valve seat, said lower fuel outlet conduit portion having an oil guiding conduit therethrough for fluidly communicating a valve chamber of a valve casing with a pressure chamber of a fuel injection pump, said integral upper neck portion having a reduced diameter portion having a tapered surface, said integral upper neck portion having a smooth outer peripheral surface parallel to the longitudinal axis of said fuel discharge valve, said smooth outer peripheral surface being a first reference engaging plane for guiding and engaging a lower inner peripheral side surface of a hollow of a valve casing, said integral upper neck portion having an upper smooth planar end face disposed perpendicular to said smooth outer peripheral surface, said upper smooth planar end face being a second reference engaging plane for engaging an inner bottom surface of a hollow of a valve casing, said smooth outer peripheral surface and said upper smooth planar end face jointly causing said fuel discharge valve to precisely mate with a valve casing; and a valve casing precisely mated with said fuel discharge valve, said valve casing having a hollow receiving said upper neck portion of said fuel discharge valve therein, said hollow having a lower inner peripheral side surface parallel to the longitudinal axis of said valve casing and precisely mating with said smooth outer peripheral surface of said upper neck portion of said fuel discharge valve, said hollow having an inner bottom surface disposed perpendicular to said lower inner peripheral side surface and precisely mating with said upper smooth planar end face of said upper neck portion of said fuel discharge valve, said valve casing having a free lower end, said free lower end being inwardly bent and engaging said tapered surface of said reduced diameter portion of said upper neck portion of said fuel discharge valve, said valve casing having a second fuel passageway for fluidly communicating said oil chamber and said first fuel passageway, and a movable check valve in said second fuel passageway for regulating the flow of a fuel therethrough.

2. A device as in claim 1, further comprising a second hollow in said fuel discharge valve, said second hollow fluidly communicating said oil guiding conduit with said valve chamber of said valve casing, and a spring disposed in said second hollow, extending into said valve chamber of said valve casing, and biasing said movable check valve for keeping said second fuel passageway normally closed.

3. A device as in claim 2, wherein said second hollow is substantially adjacent to said integral middle engaging piece of said fuel discharge valve.

4. A device as in claim 1, wherein the ratio of the longitudinal axial lengths of said valve chamber and said second hollow is about 2:1.

* * * * *